United States Patent [19]

Gallagher

[11] 4,412,435

[45] Nov. 1, 1983

[54] CONTINUOUS LAUNDERING APPARATUS

[76] Inventor: Paul H. Gallagher, 2530 Crawford Ave., Evanston, Ill. 60201

[21] Appl. No.: 374,932

[22] Filed: May 5, 1982

Related U.S. Application Data

[63] Continuation-in-part of Ser. No. 141,952, Apr. 21, 1980, Pat. No. 4,361,018.

[51] Int. Cl.[3] ..... D06F 15/00; D06F 31/00

[52] U.S. Cl. ..... 68/22 R; 68/27; 68/45; 68/53; 68/158; 198/819

[58] Field of Search ..... 8/147, 150, 159; 68/10, 68/11, 22 R, 27, 43, 44, 45, 53, 96, 148, 158, 175; 198/819

[56] References Cited

U.S. PATENT DOCUMENTS

| | | | |
|---|---|---|---|
| 3,292,397 | 12/1966 | Wooliever | 68/158 X |
| 3,442,369 | 5/1969 | Harkess | 198/819 X |
| 3,693,382 | 9/1972 | Grantham | 68/158 X |
| 3,744,277 | 7/1973 | Grantham | 68/53 |
| 3,999,646 | 12/1976 | Yoshida | 198/819 X |
| 4,159,632 | 7/1979 | Grantham | 68/158 X |

FOREIGN PATENT DOCUMENTS

| | | | |
|---|---|---|---|
| 1148181 | 5/1963 | Fed. Rep. of Germany | 198/819 |
| 1427226 | 12/1965 | France | 68/10 |

*Primary Examiner*—Philip R. Coe

*Attorney, Agent, or Firm*—Paul H. Gallagher

[57] ABSTRACT

Continuous laundering apparatus having a continuous conveyor carrying the goods to be laundered through the apparatus. Devices additional to, and separate from, the conveyor are provided for agitating the goods as they are carried by the conveyor. The conveyor is a single mesh or web, surrounding or enclosing the goods, and holding them in suspended form, and the agitators engage the conveyor, and the goods, at the sides. In one form the agitators are on opposite sides of the conveyor, engaging the conveyor against each other, and in another form, on one side and engaging it against the wall of the tank through which the goods are carried. A plurality of units provide different kinds of steps, such as washing and rinsing, and the conveyor assumes a bag shape and carries the goods between the units.

17 Claims, 19 Drawing Figures

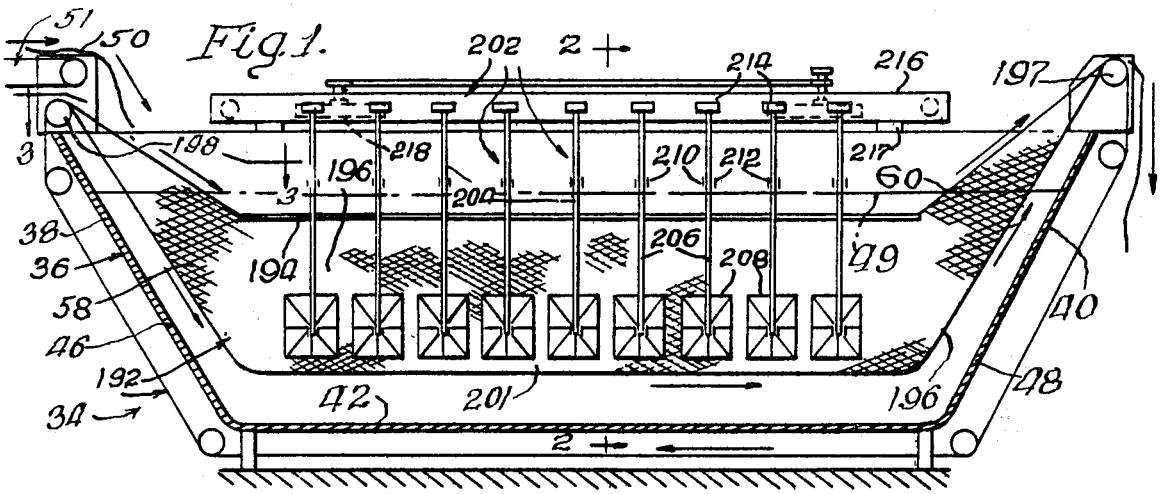
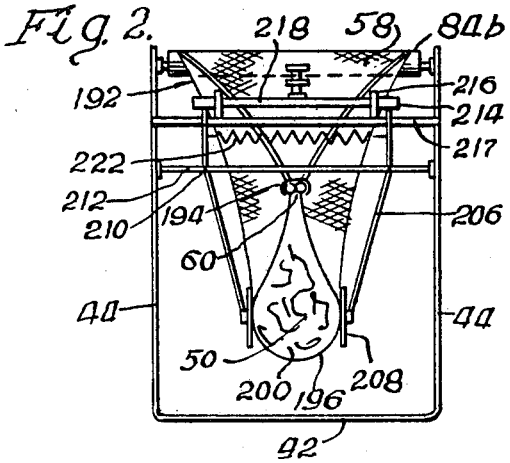
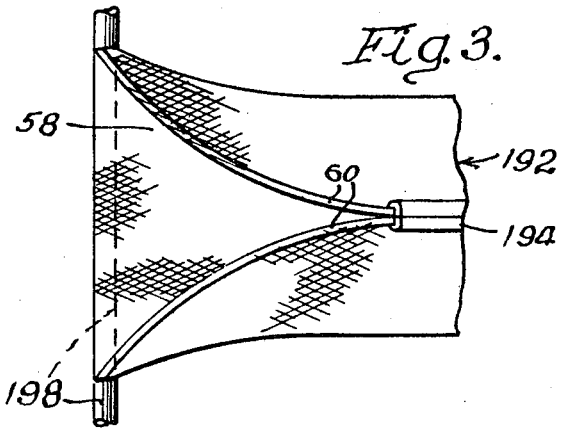
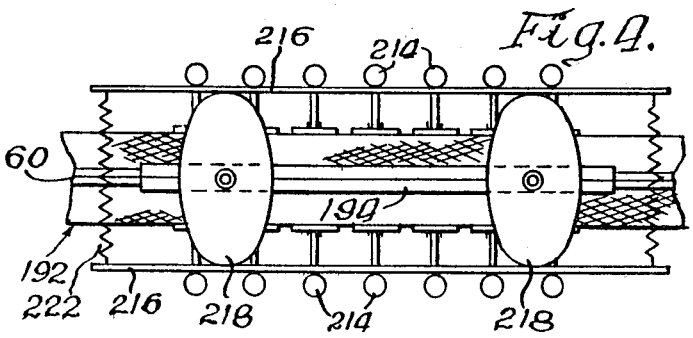
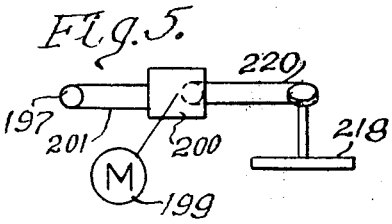
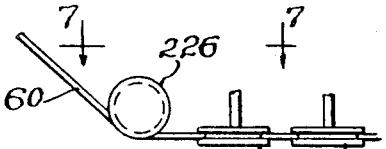
Fig. 6
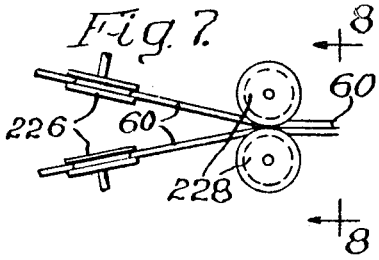
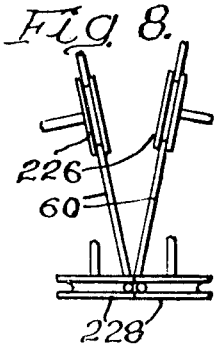

CONTINUOUS LAUNDERING APPARATUS

This application is a continuation-in-part of my prior and copending application, No. 141,952, filed Apr. 21, 1980, and now U.S. Pat. No. 4,361,018, for Continuous Laundering.

FIELD OF THE INVENTION

A serious problem that always existed in continuous laundering is that the agitation of the goods, which is considered necessary for complete laundering, renders it difficult to move the goods continuously. Continuous operation by its very nature presupposes the movement of the goods in the laundering steps, that is, in order for the laundering operation to be successful or effective, they must be moved along. Implicit is the factor that movement be controlled movement, and this further presupposes that the goods be moved along a predetermined path, because if they are not, they would be moved only randomly, and hence not continuously. Agitation works against such movement of the goods, since agitation by nature is the antithesis of controlled movement. Since agitation works against controlled movement, if the agitation reaches too great intensity, the controlled movement subsides or ceases, and steps must then be taken to re-establish it, and that in effect amounts to batch-type operation. It is often desirable to have the washing water move through the tank, and movement of the goods must include the possibility of moving them against the movement of the water, because if not, the goods would be moved with the water, and by the water, and hence the action of agitation would be nullified. Heretofore, as a practical matter, continuous movement and agitation of the goods were not effectively produced in the same operation.

This invention is directed to overcoming the foregoing difficulties, and broadly, utilizes means for positively conveying the goods and means for agitating them as they are being conveyed.

CROSS REFERENCES

U.S. Pat. No. 4,091,645, issued May 30, 1978, to myself, covering Continuous Laundering Apparatus.

U.S. Pat. No. 4,172,302, issued Oct. 30, 1979, to myself, covering Continuous Laundering Method.

Both of the above patents derived from a common parent application.

Those prior patents cover continuous laundering wherein the goods are positively conveyed through the apparatus, and constantly agitated while they are so conveyed, but in those instances, the conveyor and agitating means are the same instrumentality.

In the parent case from which the present case is derived in part, and in the present case, a conveyor positively carries the goods, but the agitating means is a separate instrumentality which agitates the goods in the conveyor while they are being conveyed.

OBJECTS OF THE INVENTION

A main object of the invention is to provide novel apparatus for continuous laundering wherein the goods to be laundered are positively carried through the apparatus, and positively agitated as they are being carried, incorporating the following novel features and advantages:

(a) The conveyor and agitating means are separate instrumentalities, producing more effective and efficient operation.

(b) A special kind of conveyor is utilized, providing convenient and effective carrying of the goods, and agitators effective for cooperation with the conveyor.

(c) A great variety of kinds of goods can be handled.

(d) The goods can be easily carried between the laundering units, as where a plurality of units are utilized for performing different kinds of laundering steps.

DESCRIPTION OF CERTAIN PREFERRED EMBODIMENTS

In the drawings:

FIG. 1 is a longitudinal vertical sectional view of a preferred form of apparatus of the invention;

FIG. 2 is a view taken at line 2—2 of FIG. 1;

FIG. 3 is a fragmentary view on an enlarged scale taken substantially at line 3—3 of FIG. 1;

FIG. 4 is a top view of the central portion of the apparatus of FIG. 1;

FIG. 5 is a diagrammatic view of a drive for the conveyor means and agitator means of FIGS. 1-4;

FIG. 6 is a simple view, without, detail, of a modified form of guide means for the conveyor, oriented in the direction of FIG. 1, and showing elements positioned as in the upper left hand portion of the latter figure;

FIG. 7 is a view taken at line 7—7 of FIG. 6;

FIG. 8 is a view taken at line 8—8 of FIG. 7;

Figures 9, 10, 11, 12, 13, 14, 15, 16, 17, 18, 19:
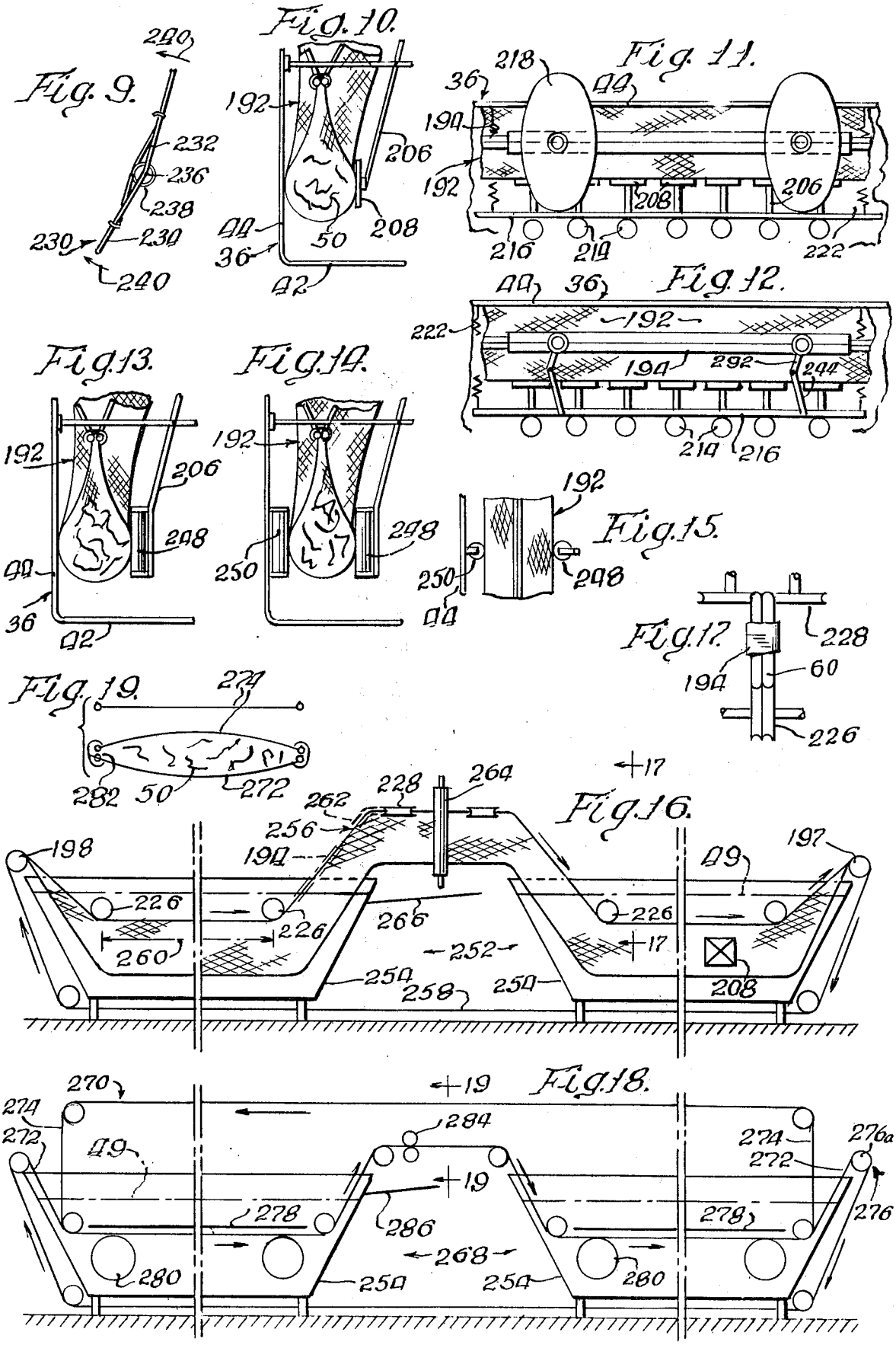
FIG. 9 is a fragmentary detail view of an arm carrying an agitator gripping plate.
FIG. 10 is a view, oriented according to FIG. 2, of a modified form of apparatus.
FIG. 11 is a top view of the apparatus of FIG. 10.
FIG. 12 is a modified form of apparatus for actuating the agitating means, oriented according to FIG. 11.
FIG. 13 is a vertical cross sectional view of another form of an agitator arrangement.
FIG. 14 is a vertical cross sectional view of a still further form of agitator arrangement.
FIG. 15 is a top view of the device of FIG. 14, being taken at line 15—15 of the latter figure.
FIG. 16 is a diagrammatic side view of a multiple-unit arrangement of laundering apparatus.
FIG. 17 is a view taken at line 17—17 of FIG. 16.
FIG. 18 is a diagrammatic side view of a multiple-unit arrangement of laundering apparatus, constituting a modified form relative to that of FIG. 16.
FIG. 19 is a sectional view taken at line 19—19 of FIG. 18.

As used herein laundering is a generic term covering different phases, including washing, rinsing, and similar processes.

Referring in detail to the drawings, and particularly to FIGS. 1-4 thereof, the apparatus as a whole is indicated at 34 and includes a tank 36 having an inlet end 38 and an outlet end 40. The tank may be of any suitable construction and includes a bottom element or floor 12, side walls 44, an end wall 46 at the inlet end, and an end wall 48 at the outlet end. The tank includes a framework for mounting other components of the apparatus as defined hereinbelow. The water level in the tank is indicated at 49.

The items to be laundered may be towels 50, for example, and are introduced at the inlet end by suitable means, such as a conveyor 51.

A single conveyor 192 is mounted in the tank 36, which is an endless belt type, of open-work, or mesh, for enabling free and virtually unimpeded flow of water therethrough. The mesh material is indicated at 58, and is provided with beads 60 at the side edges. The web is relatively wide and is doubled, with the beads 60 mounted in a channel 194 and supported thereby. The web belt thus doubled includes a depending central bag shape portion 196 in which the goods 50 are confined. The belt is trained over suitable rollers, 197 at the outlet end and 198 at the inlet end, and is driven by suitable means such as that shown in FIG. 5 which includes the roller 197. The drive means includes a driving motor 199 operating through a drive transmission unit 200 and acting through a drive belt 201, driving the roller 197. The transmission unit 200 is of variable speed character for driving the roller 197 at selected speed, and for driving other means as referred to below.

The conveyor belt 192 is opened in flat condition in passing over the rollers 197, 198 (FIG. 3) and the side edges then brought in together where they are confined by the channel 194 as noted above, this channel extending longitudinally of the tank the greater part of the length thereof. The conveyor belt 192 thus, in its central portion, includes a main or operating run 201 extending through an operating range where the goods are confined and where the agitation takes place. The goods are delivered out of the tank over the roller 197. The endless belt 192, outside of the tank, may have a return run in any convenient location, such as under the tank, as shown, over the tank, etc.

The agitating means is indicated in its entirety at 202, FIG. 1, and includes a plurality of gripping 204 each including an upright arm 206 and the gripper plate 208. The grippers are arranged in pairs with those of a pair on opposite sides of the conveyor (FIG. 2). The arms 206 are pivoted at 210 in a suitable supporting means 212 and the gripper plates 208 are pivoted in the lower ends of the arms. The pivot axes of the arms 206 extend longitudinally of the tank and the arms are provided limited rocking movement about transverse axes. The arms have cam rollers 214 at the top, which engage bars 216 extending longitudinally and spaced apart transversely. The bars 216 are supported on transverse structural pieces 217 and are moveable transversely and spread apart by a pair of longitudinally spaced cams 218 (FIGS. 2, 4) which are driven by the drive means of FIG. 5 in which the drive transmitting unit 200 acts through a drive belt 220 for driving the cams. Upon rotation of the cams, the bars are spread, and later retracted by tension springs 222 connected therebetween. Upon swinging of the upper ends of the arms 206 outwardly, by the bars 216, the lower ends are swung inwardly, whereby the gripper plates 208 grip the central portion of the conveyor belt therebetween, and thus the goods 50 therein. This gripping action produces the desired agitation of the goods. The gripper plates 208 are preferably of open-work construction.

Upon the gripper plates 208 gripping the conveyor, and because the conveyor runs continuously, the gripper plates and the lower ends of the arms 206 must necessarily swing with the movement of the conveyor. This movement is accomodated by the limited movement, referred to above, of the arms about transverse axes. In this movement also, the follower rollers 214 roll along the bars 216.

The cams 218 may be driven in synchronism so that the bars 216 at both ends spread simultaneously, and in this case all of the gripper plates 208 are moved inwardly in agitating action simultaneously. It is not necessary however that these cams act in synchronism, but may be staggered in their action, instead.

FIGS. 6–8 show alternative means for supporting the endless belt 192 in the apparatus of FIGS. 1–4. This supporting means utilizes grooved pulleys instead of the channel 194 described above. In these figures the beads 60 on the opposite side edges of the conveyor belt represent the belt. These figures also show pairs of grooved pulleys 226, 228. At the left of FIG. 6, the included beads 60 are disposed at the inlet end of the tank and they ride under pulleys 226, on axes which are generally transverse to the tank, but are not coaxial, as shown in FIG. 7. The beads 60 in the folding action of the belt, converge to form the V-shape of FIG. 7, the pulleys 226 being positioned to accommodate that disposition of the beads. The beads then pass between the pulleys 228 which are disposed on vertical axes and positioned close together, confining the beads therebetween and holding the main run 200 thereby. The pair of rollers 228 of FIG. 6 represents a succession of such rollers of any desired number and extent, to support the main run of the belt. The rollers 228 therefore serve the same purpose as the channel 194.

Attention is directed to FIG. 9 showing a detail of a modified form of the gripper arm. The gripper arm 230, corresponding to the arm 206 referred to above, is made of two sections, 232 and 234 pivoted together at 236. A torsion spring 238 is positioned about the pivot axis, with ends engaging the arm sections and biasing them in the directions of the arrows 240, but yielding to enable the lower section to move in clockwise direction, to accomodate yielding action of the arms made necessary by different thicknesses of goods in the conveyor.

The drive transmission unit 200 of FIG. 5, being of variable speed character as noted above, is operative for driving each the roller 197, and thus the conveyor belt, and the cams 218, at different selected speeds as referred to again hereinbelow.

FIGS. 10–12 show a modified form of apparatus. Referring first to FIGS. 10 and 11, the conveyor belt 192 is positioned close to one side wall 44 of the tank, and grippers 208 provided only on one side of the conveyor i.e., that side opposite the wall 44 mentioned. The grippers 208 then grip the conveyor between themselves and that side wall. FIG. 11 is a top view of the arrangement of FIG. 10 showing the cams 218 working on only the single bar 216 for actuating the grippers 208 on that side.

FIG. 12 shows an arrangement similar to that of FIGS. 10 and 11, but differs in the inclusion of crank arms 292 and pitmans 244 connected between the crank arms and the bar 216. The cranks 242 are mounted at 246 in a manner similar to the mounting of the cams 218.

In the apparatus of FIGS. 10–12, the gripper plates 208 produce an agitating effect similar to that of the previous embodiment. Since the arms 206 swing about transverse axes, with the movement of the conveyor longitudinally of the tank, the movement of the conveyor is not impeded by the gripper plate 208, notwithstanding the gripping effect between the gripper plates and the side wall. The present form of the apparatus results in a construction simpler than that of the first form.

FIGS. 13–15 show another modified form of gripper arm. In FIG. 13 each gripper arm 206 is provided with a roller 248 which directly engages the conveyor, facilitating movement of the conveyor, even though the conveyor may directly engage the wall 44 of the tank.

In this case, the rollers 214 need not be provided, but the arms 206 may be secured directly to the bar 216.

In FIGS. 14 and 15, additional rollers 250 are mounted on the tank wall 44, preferably opposed to those, 248, on the gripper arms (FIG. 15), further facilitating movement of the conveyor, reducing friction with the wall.

FIGS. 16–19 show the utilization of a plurality of laundering units to form a combined apparatus for performing a continuous operation of a plurality of laundering steps of different kinds, that is, a different laundering step may be performed in each unit, such as washing, rinsing, etc. If desired, more than the two units shown may be utilized. These figures represent two modifications of apparatus, one in FIGS. 16–17 and the other in FIGS. 18–19.

FIG. 16 shows two units 252 each including a tank 254 which may be identical with the tank 36. A conveyor belt 256, identical with the conveyor belt 192 except longer, is supported to run through both tanks serially, and the return run 258 is under the tanks. The first tank may be used for washing, and the second for rinsing, for example.

In consideration of this aspect of the invention, the conveyor belt and its mounting is especially adapted to continuity of laundering in successive units. The conveyor belt may be supported in the operating range 260 by either the channel 194, while at the ends, pulleys 226 (as in FIGS. 6–8) guide it upwardly, and at the top, as the conveyor leaves the tank, curved pieces 262 of the channel 194 direct it longitudinally, and between those pieces, pulleys 228 (as in FIGS. 6–8) guide and support it. If desired, wringer rollers 264 may be utilized at a suitable location, such as between the units, and a return-run scoop 266 catches the wrung water and returns it to the first tank.

Since the conveyor is made up of a single continuous belt, and it entirely encloses and supports the goods by itself, in its bag shape form, the goods are most easily carried in suspended form, as between the tanks.

In the form shown in FIGS. 18, 19 two units 268 are shown, utilizing conveyor means disclosed in the parent application identified above—Ser. No. 141,952. The conveyor means 270 is made up of two continuous or endless belts 272, 274. The belt 272 is trained on various rollers 276, one of which **276*a* may be driven. The belt 272 dips down into each of the tanks 254 and it rises out of the first tank and continues in elevated position and then dips down into the second tank, and then again up out of the second tank and down under the two tanks in return. The belt 274 dips down into each of the tanks and follows the course of the belt 272 throughout most of the length of the two tanks. At the ends of the tanks it rises to a position above the tanks in return. In each tank there is a reaction plate 278 above the runs of the two belts, and under these runs are a plurality of agitator rolls 280** which are driven by suitable means.

The endless belts 272, 274 are similar to the belts referred to above in that water can easily flush therethrough. The belts are generally flat and have beads 282 at their edges, and the two belts are gripped and held by channels 194 referred to above. These channels hold the edges of the belts securely and form, in effect, a tube of the runs of the belts within the tank and above at the center. The goods 50 are shown confined between the two runs in FIG. 19. Wringer rollers 284 may be provided, and the water therefrom may drop onto a return scoop 286 which carries the water back to the first tank 268.

In FIGS. 18, 19 the conveyor means is also effective for carrying the goods into and through the tanks, and particularly carrying them out of the first tank and back into the next tank.

The channels 194 as will be understood, are shaped appropriately to carry the runs of the belt under the reaction plates, up out of the first tank, across the top, and down again into the second tank and under the reaction plate in the second tank.

The conveyor and agitating means may be driven at selectively chosen speeds according to various factors involved, such as the toughness or fragility of the goods, the character of the soil to be removed, whether it is a washing or a rinsing operation, etc. The apparatus is adapted to different phases of laundering, such as washing, rinsing, etc., as indicated above, and in this aspect of the operation, a plurality of units of such apparatus are utilized in serial arrangement, as described, the goods passing from one unit to the next, and the rate of progression or conveying of the goods through the series of units, may be at a uniform speed. The degree of agitation in the different units may be varied, according to the factors involved as referred to, while the movement of the conveyor through the overall operation is uniform in speed.

The goods are confined in their conveyance through the apparatus and thus the operation is continuous in the strictest sense of the word. The agitation may be provided to any extent, without in any way interfering with such a conveyance of the goods. The goods are not displaced longitudinally of the belt means, at least to any great extent, or to an extent that would impede or interfere with the conveyance of the goods.

The agitating action, being spaced along the length of the line of conveyance, produces an exceptionally good agitating action. The agitation takes place both in compressing the goods, and in withdrawing the agitating elements away from the goods, this action being accomplished at least partially by the general turbulence of the water which constantly tends to move the goods around, and consequently the goods after being compressed by one agitating component, are moved out of a compressed condition and again are moved into a compressed condition by the next or following agitating component.

Because of the confinement of the goods by the conveyor means, and the controlled movement of the goods along the predetermined path, they are conveyed in such path independently of the action of the water, there being no possibility of goods being displaced out of the conveyor. Another direct and immediate benefit of this feature is that the water may flow in direction opposite to the movement of the goods with a known beneficial effect.

I claim:

1. Laundering apparatus comprising, a tank for holding laundering water and having an inlet end and an outlet end, conveyor means for positively conveying goods continuously from the inlet end through the tank through an operating range and through laundering water therein to the outlet end, the conveyor means including an endless belt of open-work material, and being of a single piece and surrounding and enclosing the goods, and agitating means operative for engaging the conveyor means and thereby agitating the goods in the conveyor means.

2. Laundering apparatus according to claim 1 wherein, the conveyor means includes a main run in the tank in said operating range, the endless belt in said run thereof being folded in loop form, as viewed in transverse cross section, with side edges uppermost and mounted at the side edges for longitudinal movement, and the central portion thereof forming a depending bag shape, and the goods are supported in the bag shape portion.

3. Laundering apparatus according to claim 2 wherein, the conveyor belt includes enlarged beads at its side edges, and the apparatus includes mounting means gripping said beads and thereby supporting the conveyor belt and enabling the central portion thereof to depend.

4. Laundering apparatus according to claim 3 wherein, the mounting means includes channels confining the beads and in which they slide.

5. Laundering apparatus according to claim 3 wherein, the mounting means includes grooved pulleys confining the beads.

6. Laundering apparatus according to claim 2 wherein, the agitating means includes grippers intermittently engaging the bag shape portion on opposite sides thereof.

7. Laundering apparatus according to claim 6 wherein, said grippers of the agitating means are free floating whereby to accommodate independent-drive movement of the conveyor means.

8. Laundering apparatus according to claim 7 wherein, the agitating means includes upright arms with the grippers mounted on the lower ends thereof, the arms being mounted for swinging movement about axes extending longitudinally of the conveyor for transverse movement into and out of engagement with the endless belt, the arms being mounted also for limited movement about transverse axes to enable corresponding longitudinal movement of the grippers while in gripping engagement with the endless belt, and driving means for intermittently swinging said arms for moving the grippers into engagement with the endless belt.

9. Laundering apparatus according to claim 2 wherein the tank has side walls and further wherein, the agitating means includes grippers engaging the conveyor belt on one side of the latter, and gripping it between themselves and a side wall of the tank.

10. Laundering apparatus according to claim 9 wherein, the agitating means includes downwardly extending arms supporting the grippers, and the grippers include rollers rollingly engaging the conveyor.

11. Laundering apparatus according to claim 10 wherein, the said side wall of the tank is provided with rollers opposite those on the arms and the opposed rollers grip the conveyor therebetween.

12. Laundering apparatus according to claim 2 wherein, that apparatus constitutes one of a plurality of essentially identical units in a combined apparatus, the combined apparatus including means for carrying the conveyor belt between adjacent tanks with the goods supported in the conveyor belt.

13. Laundering apparatus according to claim 12 and including, means for supporting the conveyor belt at its side edges at positions between the units, and retaining it in bag shape form at those positions, with the goods supported therein.

14. Laundering apparatus according to claim 13 and including, wringer means interposed at locations between adjacent units operative for wringing the goods while in the conveyor belt at those locations.

15. Laundering apparatus according to claim 13 wherein, the conveyor belt is provided with enlarged beads at its side edges, and the apparatus includes means for mounting the conveyor belt by means of gripping the beads and enabling the central portion to depend, and said mounting means are distributed throughout each of the units and between the adjacent units.

16. Laundering apparatus according to claim 1 wherein, the agitating action takes place throughout an operating range, and the conveyor belt entirely surrounds and confines the goods throughout the operating range.

17. Laundering apparatus according to claim 1 wherein, that apparatus constitutes one of a plurality of essentially identical units in a combined apparatus, the open-work material of the endless belt being of such character as to enable water to flush therethrough freely and substantially unimpeded, the endless belt entirely confines the goods throughout their travel through each unit and between the units, and wringer means is interposed between adjacent units operative for wringing the goods in the conveyor belt, and the open-work material of the conveyor belt also enabling water wrung from the goods to flow therethrough freely and substantially unimpeded.

* * * * *